US009878352B2

(12) United States Patent
Buckner

(10) Patent No.: US 9,878,352 B2
(45) Date of Patent: Jan. 30, 2018

(54) HIGH PRESSURE SURFACE CLEANER AND RELATED METHODS

(71) Applicant: Don M. Buckner, Okahumpka, FL (US)

(72) Inventor: Don M. Buckner, Okahumpka, FL (US)

( * ) Notice: Subject to any disclaimer, the term of this patent is extended or adjusted under 35 U.S.C. 154(b) by 0 days.

(21) Appl. No.: 15/089,709

(22) Filed: Apr. 4, 2016

(65) Prior Publication Data

US 2017/0282218 A1 Oct. 5, 2017

(51) Int. Cl.

| | |
|---|---|
| ***A47L 11/14*** | (2006.01) |
| ***A47L 11/40*** | (2006.01) |
| ***B05B 3/06*** | (2006.01) |
| ***B05B 9/01*** | (2006.01) |
| ***B05B 15/04*** | (2006.01) |
| ***B08B 1/04*** | (2006.01) |
| ***B08B 3/02*** | (2006.01) |
| ***E01H 3/00*** | (2006.01) |

(52) U.S. Cl.

CPC ..... *B08B 3/024* (2013.01); *A47L 11/145* (2013.01); *A47L 11/4088* (2013.01); *B05B 3/06* (2013.01); *B05B 9/01* (2013.01); *B05B 15/0437* (2013.01); *B05B 15/0443* (2013.01); *B08B 1/04* (2013.01); *B08B 3/026* (2013.01); *E01H 3/00* (2013.01)

(58) Field of Classification Search

CPC ..... A47L 11/145; A47L 11/4088; B05B 3/06; B05B 9/01; B05B 15/0437; B05B 15/0443; B08B 1/04; B08B 3/024; B08B 3/026; E01H 3/00

USPC ..... 134/95.1, 172, 173, 176, 177, 179, 180; 239/104, 253, 258, 261

See application file for complete search history.

(56) References Cited

U.S. PATENT DOCUMENTS

| | | | | |
|---|---|---|---|---|
| 4,821,961 | A | 4/1989 | Shook | |
| 4,895,179 | A | 1/1990 | Hart | |
| 5,135,015 | A | 8/1992 | Young | |
| 7,308,900 | B2 | 12/2007 | Otterson | |
| 8,118,241 | B2 | 2/2012 | Gardner et al. | |
| 2008/0265058 | A1* | 10/2008 | Wimmer | B05B 3/0463 239/258 |
| 2008/0289661 | A1 | 11/2008 | Otterson | |
| 2009/0223541 | A1* | 9/2009 | Gardner | A47L 11/26 134/174 |
| 2012/0138706 | A1 | 6/2012 | Wesch et al. | |

(Continued)

*Primary Examiner* — Levon J Shahinian

(74) *Attorney, Agent, or Firm* — Matthew G. McKinney, Esq.; Allen, Dyer, Doppelt + Gilchrist, PA

(57) ABSTRACT

A high pressure surface cleaner includes a housing having an open end, a high pressure coupling in fluid communication with the housing and having a first end and a second end, the first end configured to receive a high pressure water source, and a supply conduit rotatably secured to the second end of the high pressure coupling and configured to rotate about the high pressure coupling defining a horizontal plane within the housing. The cleaner also includes first and second nozzles having a vertical axis therethrough and secured proximate to the first and opposing second ends of the supply conduit, respectively, the vertical axis of the first and second nozzles approximately normal to the first horizontal plane, and a directional nozzle coupled to the supply conduit and having a directional outlet orientated to cause the supply conduit with the first and second nozzles to rotate when discharging water.

16 Claims, 3 Drawing Sheets

(56) References Cited

U.S. PATENT DOCUMENTS

| | | | | |
|---|---|---|---|---|
| 2012/0175431 | A1* | 7/2012 | Althammer | A61B 90/70<br>239/263 |
| 2013/0118529 | A1 | 5/2013 | Gromes, Sr. | |
| 2016/0083927 | A1 | 3/2016 | Spreitzer et al. | |

* cited by examiner

FIG. 3
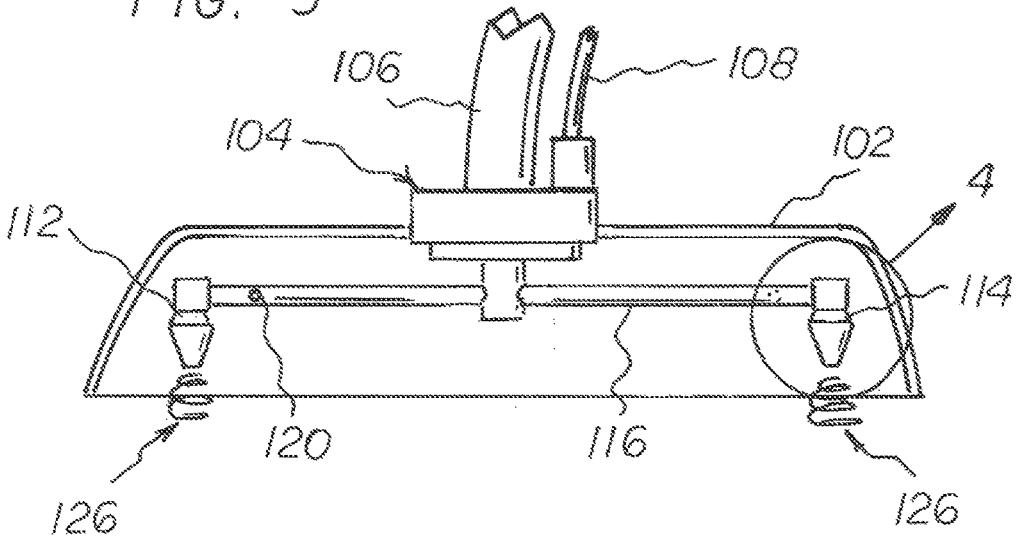
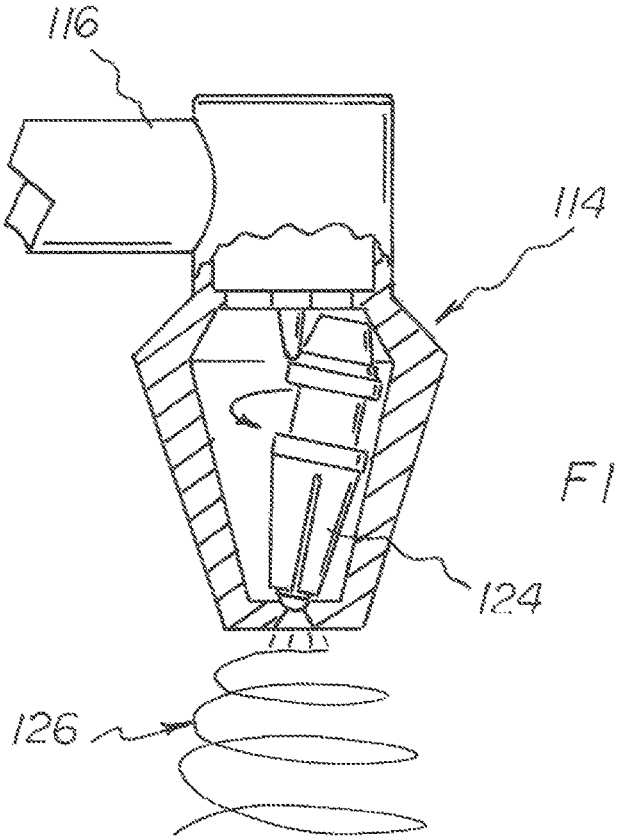
FIG. 4

FIG. 5
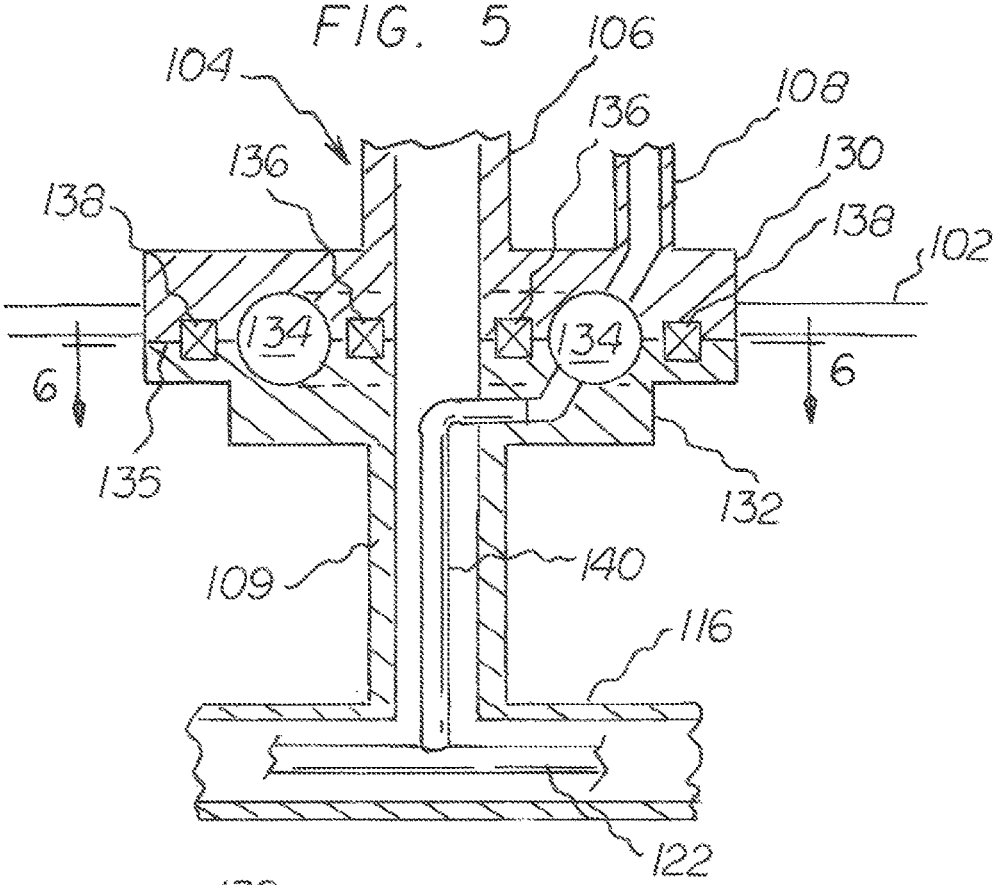
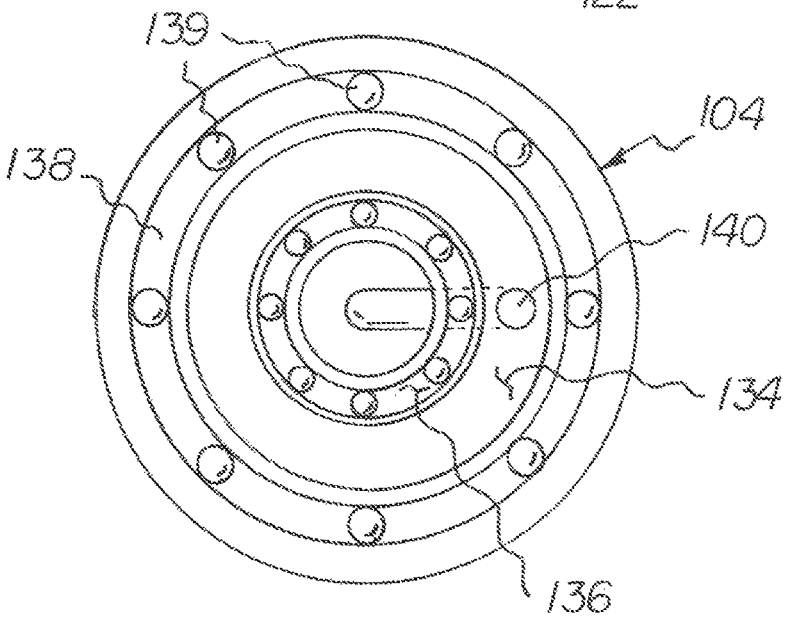
FIG. 6

HIGH PRESSURE SURFACE CLEANER AND RELATED METHODS

FIELD

The present invention relates to the field of cleaning devices, and, more particularly, to a surface cleaner and related methods.

BACKGROUND

High pressure surface cleaners are useful for cleaning driveways, sidewalks, decks, and roofs. A typical surface cleaner includes an engine that powers a high pressure pump. The pump is connected to a water source such as a low pressure hose, and the output of the pump is a high pressure line connected to a surface cleaner brush with rotating nozzles.

A shortcoming of the high pressure surface cleaners is that the water is sprayed at high enough pressure that it can damage the surface that is being cleaned. One approach to reduce the damages is to continually move the surface cleaner brush to avoid direct high pressure spray from the rotating nozzles for a prolonged period on one spot. Another approach is to use a pressure control valve on the high pressure side of to regulate the spray pressure and to reduce damage to the surface being cleaned.

The shortcomings of the existing high pressure surface cleaners are especially prevalent where the surface that is being cleaned is easily damaged. For example, flat surfaces that are painted or coated, such as tennis courts, may easily be damaged by improper use of the high pressure surface cleaner.

Accordingly, there is a need in the art for improved high pressure surface cleaner.

SUMMARY

In view of the foregoing background, it is therefore an object of the present invention to provide a reliable and efficient high pressure surface cleaner.

This and other objects, features, and advantages in accordance with the present invention are provided by a high pressure surface cleaner. The high pressure surface cleaner includes a housing having an open end and a high pressure coupling in fluid communication with the housing and having a first end and a second end where the first end is configured to receive a high pressure water source. In addition, the cleaner includes a supply conduit rotatably secured to the second end of the high pressure coupling and is configured to rotate about the high pressure coupling defining a horizontal plane within the housing. The first and second nozzles include a vertical axis therethrough and are secured proximate to the first and opposing second ends of the supply conduit, respectively, where the vertical axis of the first and second nozzles are approximately normal to the first horizontal plane. The cleaner also includes a directional nozzle coupled to the supply conduit and having a directional outlet orientated to cause the supply conduit with the first and second nozzles to rotate when discharging water through the directional outlet.

In another embodiment a method of fabricating a high pressure surface cleaner is disclosed. The method includes connecting a housing to a high pressure coupling in fluid communication with the housing and having a first end and a second end where the first end is configured to receive a high pressure water source. The method also includes rotatably securing a supply conduit to the second end of the high pressure coupling which is configured to rotate about the high pressure coupling defining a horizontal plane within the housing, and securing first and second rotary type nozzles with each having a vertical axis therethrough proximate to the first and opposing second ends of the supply conduit, respectively, where the vertical axis of the first and second nozzles are approximately normal to the first horizontal plane. In addition, the method includes forming a directional nozzle to the supply conduit which is orientated to cause the supply conduit with the first and second nozzles to rotate when discharging water through the directional outlet, and securing an adjustable valve inline with the directional nozzle which is configured to control a speed of rotation of the supply conduit.

BRIEF DESCRIPTION OF THE DRAWINGS

FIG. 3 is a sectional view along line 3-3 of FIG. 2;

FIG. 4 is a sectional view of a rotary type nozzle of the high pressure surface cleaner;

FIG. 5 is a sectional view of a rotary coupling of the high pressure surface cleaner; and FIG. 6 is a sectional view along the line 6-6 FIG. 5 showing the rotary coupling.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
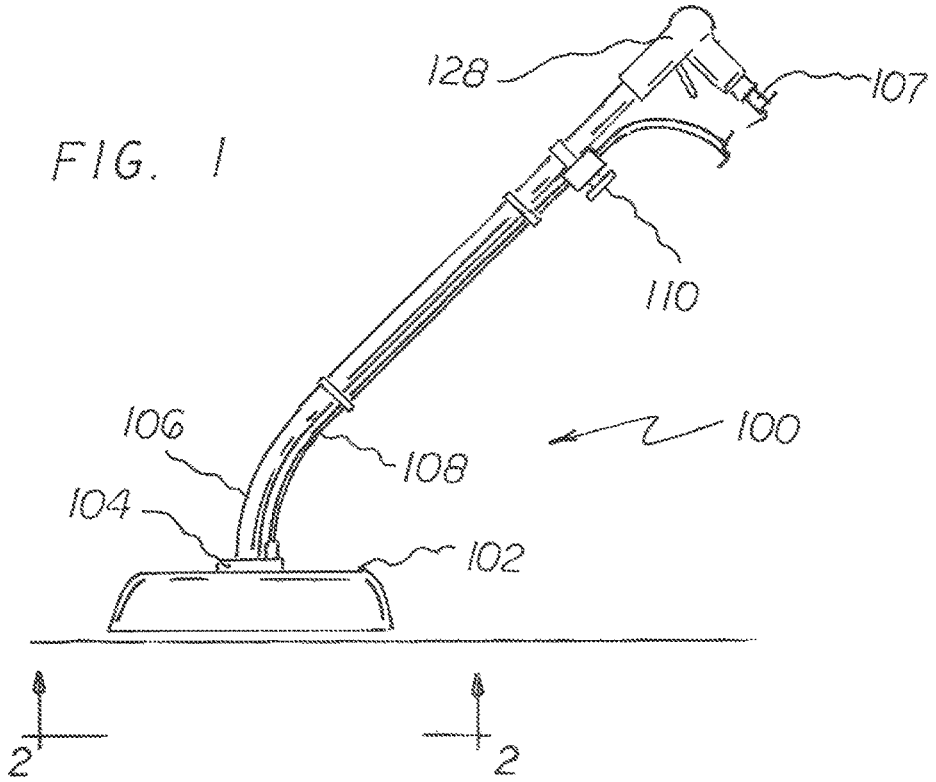
FIG. 1 is a top perspective view of the high pressure surface cleaner in accordance with an embodiment of the present invention.
Figure 2:
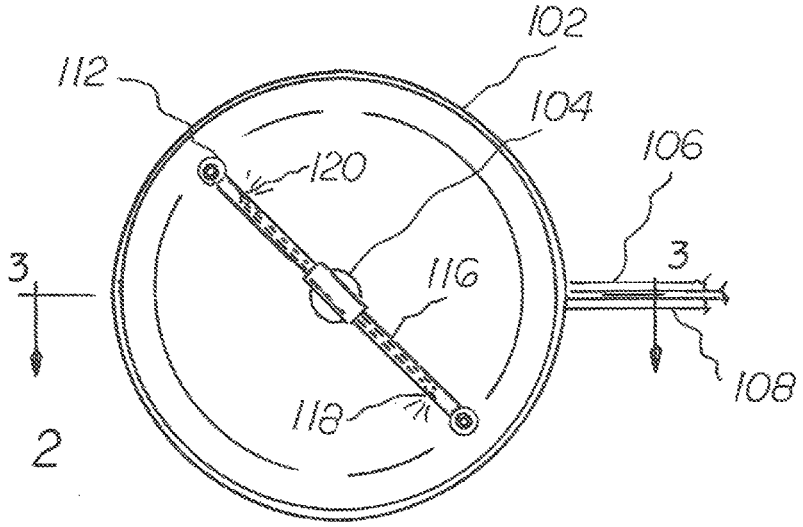
FIG. 2 is a bottom view of the high pressure surface cleaner of FIG. 1.

With reference to FIGS. 1-3, a high pressure surface cleaner 100 is now described. The high pressure surface cleaner 100 includes a housing 102 having an open end, and a high pressure rotary coupling 104, which is in fluid communication a high pressure water supply 107. The high pressure rotary coupling 104 has a first end and a second end, where the first end is configured to receive a spray wand 106 that is connected to the high pressure water supply 107. A supply conduit 116 is rotatably secured to the second end of the high pressure rotary coupling 104 and is configured to rotate and spin about the high pressure rotary coupling 104 defining a horizontal plane within the housing 102. The supply conduit 116 may be rigid tubing and secured about its central portion so that an equal amount of the supply conduit 116 extends away from the high pressure rotary coupling 104 on each end. The high pressure rotary coupling 104 may be generally located in the center of the housing 102.

A first nozzle 112 and a second nozzle 114 are secured proximate to the first and opposing second ends of the supply conduit 116. The first 112 and second nozzles 114 have a vertical axis therethrough aligned with the direction of the spray. The vertical axis of the first 112 and second nozzles 114 may be approximately normal (i.e., perpendicular) to the first horizontal plane. Directional nozzles 118, 120 are coupled to a directional supply line 122 (see FIG. 5), where the directional supply line is shown within the supply line 116. The directional nozzles 118, 120 are orientated to cause the supply conduit 116 (with the first 112 and second nozzles 114) to rotate when discharging water through the directional nozzles 118, 120.

An adjustable valve 110 may be in fluid communication with the high pressure water supply 107 and the supply directional water line 108 that feeds the directional nozzles 118, 120 via the supply directional water line 122. The adjustable valve 110 may be used to control a speed of rotation of the supply conduit 116 and the nozzles 112 and 114 by varying the flow of water through the directional water line 122 to the directional nozzles 118, 120 in order to change the speed of rotation of the supply conduit 116 and the first 112 and second nozzles 114.

The first 112 and second nozzles 114 may be rotary type nozzles that generate a dynamic spray pattern 126 under pressure. Accordingly, the nozzles 112 and 114 may be slow moving or stationary without damaging the surface being cleaned. This is an advantage over existing high pressure cleaners that use static nozzles that can easily damage surfaces that emit a flat stream of high pressure water. The rotary type nozzles 112 and 114 each include a rotor 124, where a discharge angle of the high pressure water changes as the rotor 124 rotates within the respective nozzle 112, 114.

Accordingly, a spray direction of the first 112 and second nozzles 114 may be biased to not rotate the supply conduit when the respective directional nozzle is not discharging water through the directional outlet. In other words, the nozzles 112 and 114 can spray directly downward on to the surface rather than being angled in order to provide more efficient and improved cleaning while the directional nozzles 118, 120 cause the circular rotation of the nozzles 112 and 114. The existing surface cleaners require nozzles to be angled in order to not damage the surface being cleaned and also to provide the circular rotation of the nozzles.

In another embodiment, the angle and/pr spray pattern of the nozzles 112, 114 may be adjusted to control and drive the rotation of the supply conduit 116. Alternatively, an electric or hydraulic motor may be used to control and drive the rotation of the supply conduit 116.

Referring now to FIGS. 5 and 6, the high pressure rotary coupling 104 is shown in more detail. The high pressure rotary coupling includes a top portion 130 and a bottom portion 132. The top portion 130 is secured to the housing 102 and does not rotate. The bottom portion 132 does rotate relative to the housing 102 along with the supply conduit 116 and the first 112 and second nozzles 114. The division between the top portion 130 and the bottom portion 132 is defined along line 135 in FIG. 5.

As the spray wand 106 is connected to the high pressure rotary coupling 104 through the center of the housing, the spray wand 106 and a main stub 109 connecting to the supply conduit do not twist when the bottom portion 132 rotates. In contrast to the spray wand 106, the supply directional water line 108 is offset from the center of the high pressure rotary coupling 104 so that a directional stub 140 that feeds the directional water line 122. The high pressure rotary coupling 104 is configured so that the directional stub 140 can rotate with the supply conduit 116 while the supply directional water line 108 does not rotate. The high pressure rotary coupling 104 is used to prevent the supply directional water line 108 and the directional stub 140 from twisting.

The high pressure rotary coupling 104 includes an inner raceway 136 and an outer raceway 138, which are concentric and sealed. In between the inner raceway 136 and the outer raceway 138 is a channel 134 that is also concentric and in fluid communication with the supply directional water line 108 and the directional stub 140. The inner race way 136 includes a plurality of inner ball bearings 137 and the outer raceway 138 includes a plurality of outer ball bearings 139 that allows the bottom portion 132 to rotate about the top portion 130.

The channel 134 is filled with water from the supply directional water line 108 as the lower portion 132 rotates using the inner 137 and outer roller bearings 139, and constantly feeds the directional stub 140 even though the directional stub 140 is rotating around and not aligned with the supply directional water line 108.

In a particular embodiment, the spray wand 106 may include a trigger handle 128 to control a flow of the high pressure water to the high pressure rotary coupling 104.

An engine and high pressure pump (not shown) may operate in a conventional manner to provide the high pressure water for the surface cleaner 100. All couplings, nozzles and fitting described herein may be fitted with quick connect couplings, if desired, so that the components may be quickly connected and disconnected.

In another particular embodiment, a method of using a high pressure surface cleaner may include connecting a housing to a high pressure coupling in fluid communication with the housing and having a first end and a second end where the first end is configured to receive a high pressure water source. The method also includes rotatably securing a supply conduit to the second end of the high pressure coupling which is configured to rotate about the high pressure coupling defining a horizontal plane within the housing, and securing first and second rotary type nozzles with each having a vertical axis therethrough proximate to the first and opposing second ends of the supply conduit, respectively, where the vertical axis of the first and second nozzles are approximately normal to the first horizontal plane.

In addition, the method may include connecting a directional nozzle to the supply conduit which is orientated to cause the supply conduit with the first and second nozzles to rotate when discharging water through the directional outlet, and securing an adjustable valve inline with the directional nozzle which is configured to control a speed of rotation of the supply conduit.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A high pressure surface cleaner comprising:

a housing having an open end;

a high pressure coupling in fluid communication with the housing and having a first end and a second end, the first end configured to receive a high pressure water source;

a supply conduit rotatably secured to the second end of the high pressure coupling and configured to rotate about the high pressure coupling defining a horizontal plane within the housing;

first and second nozzles having a vertical axis therethrough and secured proximate to first and opposing second ends of the supply conduit, respectively, the vertical axis of the first and second nozzles approximately normal to the horizontal plane, the first and second nozzles comprise rotary type nozzles;

a directional water line within the supply conduit and separate from the supply conduit; and at least one directional nozzle coupled to the directional water line and positioned along the supply conduit between the high pressure coupling and one of the first and second nozzles.

2. The high pressure surface cleaner of claim 1, wherein the at least one directional nozzle having a directional outlet orientated to cause the supply conduit with the first and second nozzles to rotate when discharging water.

3. The high pressure surface cleaner of claim 2, further comprising an adjustable valve in fluid communication with the at least one directional nozzle and configured to control a speed of rotation of the supply conduit.

4. The high pressure surface cleaner of claim 3, wherein the adjustable valve is configured to vary a flow of water to the at least one directional nozzle to change the speed of rotation of the supply conduit.

5. The high pressure surface cleaner of claim 2, wherein a spray direction of the first and second nozzles is biased to not rotate the supply conduit when the at least one directional nozzle is not discharging water through the directional outlet.

6. The high pressure surface cleaner of claim 1, wherein the supply conduit having a first end and an opposing second end of the supply conduit extending outwardly from the high pressure coupling.

7. The high pressure surface cleaner of claim 1, the first and second nozzles each having a rotor, wherein a discharge angle of the high pressure water changes as the rotor rotates within the respective nozzle.

8. The high pressure surface cleaner of claim 1, further comprising a spray wand coupled to the first end of the high pressure coupling.

9. The high pressure surface cleaner of claim 8, wherein the spray wand further comprises a trigger to control a flow of the high pressure water to the high pressure coupling.

10. A high pressure surface cleaner comprising:

a housing having an open end;

a high pressure coupling in fluid communication with the housing and having a first end and a second end, the first end configured to receive a high pressure water source;

a supply conduit rotatably secured to the second end of the high pressure coupling and configured to rotate about the high pressure coupling defining a horizontal plane within the housing;

first and second nozzles secured proximate to first and opposing second ends of the supply conduit, respectively, the first and second nozzles comprise rotary type nozzles;

a directional water line within the supply conduit and separate from the supply conduit;

at least one directional nozzle coupled to the directional water line and positioned along the supply conduit between the high pressure coupling and one of the first and second nozzles, and having a directional outlet orientated to cause the supply conduit with the first and second nozzles to rotate when discharging water through the directional outlet; and an adjustable valve in fluid communication with the at least one directional nozzle and configured to control a speed of rotation of the supply conduit.

11. The high pressure surface cleaner of claim 10, wherein the first and second nozzles generate a dynamic spray pattern under pressure.

12. The high pressure surface cleaner of claim 11, wherein the first and second nozzles each have a rotor that causes a discharge angle of the high pressure water to change as the rotor rotates within the respective nozzle.

13. The high pressure surface cleaner of claim 11, wherein the adjustable valve is configured to vary a flow of water to the at least one directional nozzle to change the speed of rotation of the supply conduit.

14. The high pressure surface cleaner of claim 11, wherein a spray direction of the first and second nozzles is biased to not rotate the supply conduit when the at least one directional nozzle is not discharging water through the directional outlet.

15. The high pressure surface cleaner of claim 11, further comprising a spray wand coupled to the first end of the high pressure coupling.

16. The high pressure surface cleaner of claim 15, wherein the spray wand further comprises a trigger to control a flow of the high pressure water to the high pressure coupling.

* * * * *